US007637354B2

(12) United States Patent
Kawai

(10) Patent No.: US 7,637,354 B2
(45) Date of Patent: Dec. 29, 2009

(54) EVACUATION SYSTEM AND METHOD FOR ELEVATOR CONTROL USING NUMBER OF PEOPLE REMAINING

(75) Inventor: Kiyoji Kawai, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/116,025

(22) Filed: May 6, 2008

(65) Prior Publication Data

US 2008/0202861 A1 Aug. 28, 2008

Related U.S. Application Data

(62) Division of application No. 11/688,678, filed on Mar. 20, 2007, now Pat. No. 7,413,059, which is a division of application No. 10/516,541, filed as application No. PCT/JP03/05977 on May 14, 2003, now Pat. No. 7,210,564.

(51) Int. Cl.
*B66B 1/20* (2006.01)

(52) U.S. Cl. ..... 187/313; 187/384; 187/392

(58) Field of Classification Search ..... 187/313, 187/316, 317, 280–288, 391, 393
See application file for complete search history.

(56) References Cited

U.S. PATENT DOCUMENTS

| | | | | |
|---|---|---|---|---|
| 4,023,146 | A * | 5/1977 | Carroll | 710/113 |
| 5,979,607 | A * | 11/1999 | Allen | 187/390 |
| 6,000,505 | A * | 12/1999 | Allen | 187/391 |
| 7,182,174 | B2 * | 2/2007 | Parrini et al. | 182/18 |
| 7,210,564 | B2 * | 5/2007 | Kawai | 187/384 |
| 7,413,059 | B2 * | 8/2008 | Kawai | 187/384 |
| 2004/0163325 | A1 | 8/2004 | Parrini et al. | |
| 2006/0054420 | A1 | 3/2006 | Gordon et al. | |
| 2006/0201751 | A1 | 9/2006 | Kawai | |
| 2008/0067006 | A1 | 3/2008 | Hikita et al. | |

FOREIGN PATENT DOCUMENTS

| | | | | |
|---|---|---|---|---|
| JP | 52-106550 | | | 9/1977 |
| JP | 57-33177 | A | | 2/1982 |
| JP | 58-52171 | A | | 3/1983 |
| JP | 2-198994 | A | | 8/1990 |
| JP | 3-152083 | A | | 6/1991 |
| JP | 4-354789 | A | | 12/1992 |
| JP | 5-8954 | A | | 1/1993 |
| JP | 5-147849 | A | | 6/1993 |
| JP | 8-268656 | A | | 10/1996 |
| JP | 10-182029 | A | | 7/1998 |
| JP | 2006193296 | A | * | 7/2006 |
| JP | 2007039167 | A | * | 2/2007 |
| WO | 99/50165 | A1 | | 10/1999 |

* cited by examiner

*Primary Examiner*—Jonathan Salata
(74) *Attorney, Agent, or Firm*—Sughrue Mion, PLLC

(57) ABSTRACT

An elevator system and method where an evacuation elevator control portion devises an evacuation plan making use of an elevator based on disaster information in the event of a disaster, and generates a command to perform an evacuation operation based on the evacuation plan. The evacuation elevator control portion further determines a number of people remaining inside a building and transmits the information outside of the building. An elevator operation control portion is provided for operating an elevator according to the command.

2 Claims, 16 Drawing Sheets

9 = position switch
7 = counterweight
TD = temperature detector
Fd = fire detector

FIG. 5

| MEMORY ADDRESS B+(j) | FLOOR FL(j) | ENROLLMENT Mn(j) | NUMBER OF EMERGENCY-STAIRCASE-EVACUEE Ms(j) | NUMBER OF EVACUEE USED ELEVATOR Me(j) |
|---|---|---|---|---|
| j:1 | FLOOR2 F2 | 300 | 290 | 10 |
| | FLOOR3 F3 | 300 | 250 | 50 |
| | FLOOR4 F4 | 400 | 100 | 300 |
| | FLOOR5 F5 | 300 | 50 | 250 |

33a:EVACUEE-NUMBER TABLE

FIG. 6

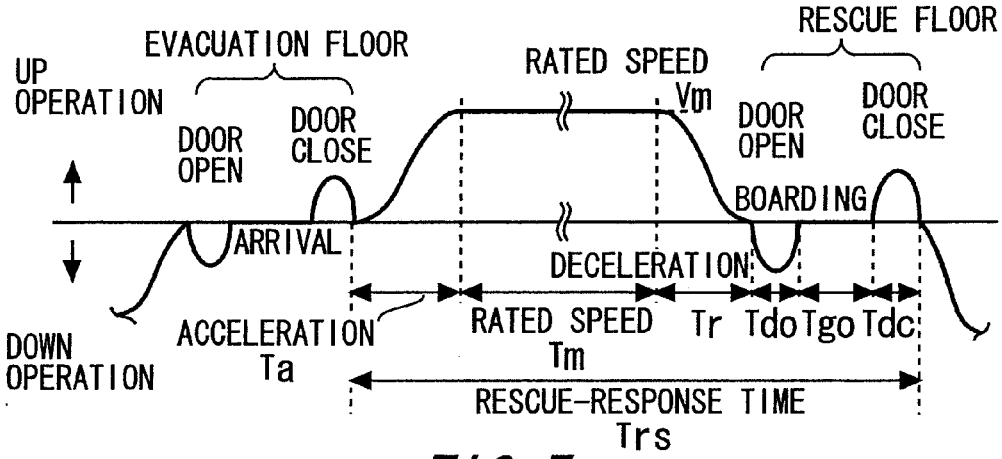

FIG. 7

RATED SPEED Vm=90m/min, IN CASE OF 11PASSENGER UNIT:SECONDS

| MEMORY ADDRESS G+(k) | FLOOR FL FL(k) | DISTANCE FROM EVACUATION FLOOR Ds(k) | ACCELERATION TIME Ta(k) | TIME AT RATED SPEED Tm(k) | DECELERATION TIME Tr(k) | DOOR OPENING-CLOSING TIME Toc(k) (Tdo+Tdc) | BOARDING TIME Tgo(k) | RESCUE-RESPONSE TIME Trs(k) |
|---|---|---|---|---|---|---|---|---|
| k:1 | FLOOR2 F2 | 3 | 1.5 | 0.5 | 1.5 | 4 | 9 | 19.5 |
| | FLOOR3 F3 | 6 | 1.5 | 2.5 | 1.5 | 4 | 9 | 24.5 |
| | FLOOR4 F4 | 9 | 1.5 | 4.5 | 1.5 | 4 | 9 | 29.5 |
| | FLOOR5 F5 | 12 | 1.5 | 6.5 | 1.5 | 4 | 9 | 34.5 |

33b:RESCUE-RESPONSE-TIME TABLE

FIG. 8

| MEMORY ADDRESS E+(g) | FIRE DETECTOR Fde(g) | FLOOR FL(g) | ACTIVATION STATE FNe(g) |
|---|---|---|---|
| g:1 | Fde1 | MACHINEROOM F7 | OFF |
| g:2 | Fde2 | HOISTWAY F6 | OFF |
| g:3 | Fde3 | FLOOR 2 F2 | OFF |
| | Fde4 | FLOOR 3 F3 | OFF |
| | Fde5 | FLOOR 4 F4 | OFF |
| | Fde6 | FLOOR 5 F5 | OFF |

ELEVATOR HALL Eh

33c:FIRE-DETECTOR-ACTIVATION TABLE
(MACHINEROOM F7, HOISTWAY F6, ELEVATOR HALL Eh)

FIG. 9

| MEMORY ADDRESS D+(m) | FIRE DETECTOR Fde(m) | FLOOR FL(m) | ACTIVATION STATE FN(m) |
|---|---|---|---|
| m:1 | Fde1 | FLOOR 2 F2 | OFF |
| | Fde2 | FLOOR 2 F2 | OFF |
| | Fde3 | FLOOR 2 F2 | OFF |
| | | | |
| | Fde21 | FLOOR 4 F4 | OFF |
| | Fde22 | FLOOR 4 F4 | ON |
| | Fde23 | FLOOR 4 F4 | ON |
| | | | |
| | Fde28 | FLOOR 5 F5 | OFF |

33d:FIRE-DETECTOR-ACTIVATION TABLE (ROOM Rm)

FIG. 10

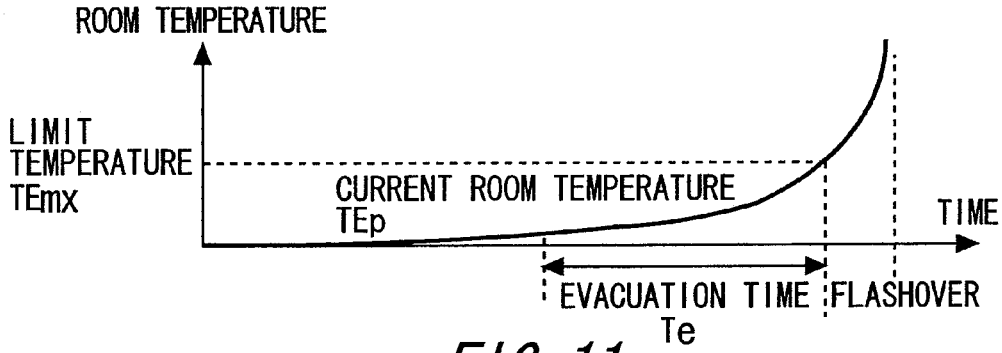

FIG. 11

| MEMORY ADDRESS A+(i) | ELEVATOR HALL FL(i) | CURRENT ROOM TEMPERATURE TEp(i) | EVACUATION TIME Te(i) |
|---|---|---|---|
| i:1 | FLOOR 2 F2 | 24°C | 90MINUTES |
| | FLOOR 3 F3 | 25°C | 80MINUTES |
| | FLOOR 4 F4 | 70°C | 10MINUTES |
| | FLOOR 5 F5 | 50°C | 20MINUTES |

33e:EVACUATION-TIME TABLE

FIG. 12

| MEMORY ADDRESS U+(p) | FLOOR FL(p) | EVACUATION TIME Te(p) |
|---|---|---|
| p:1 | FLOOR 4 F4 | 10MINUTES |
| | FLOOR 5 F5 | 20MINUTES |
| | FLOOR 3 F3 | 80MINUTES |
| | FLOOR 2 F2 | 90MINUTES |

33f:RESCUE-OPERATION-ORDER TABLE (EVACUATION-TIME SEQUENTIAL)

FIG. 13

| MEMORY ADDRESS F+(h) | FLOOR FL(h) | NUMBER OF EVACUEE USED ELEVATOR Me(h) | NUMBER OF REMAINDER Mrs(h) |
|---|---|---|---|
| h:1 | FLOOR 2 F2 | 10 | 10 |
| | FLOOR 3 F3 | 50 | 50 |
| | FLOOR 4 F4 | 300 | 260 |
| | FLOOR 5 F5 | 250 | 250 |

33g:REMAINDER-NUMBER TABLE

FIG. 20

| MEMORY ADDRESS V+(q) | FLOOR FL(q) | NUMBER OF REMAINDER Mrs(q) |
|---|---|---|
| q:1 | FLOOR 4 F4 | 260 |
| | FLOOR 5 F5 | 250 |
| | FLOOR 3 F3 | 50 |
| | FLOOR 2 F2 | 10 |

33h:RESCUE-OPERATION-ORDER TABLE (IN REMAINDER-NUMBER ORDER)

FIG. 21

| MEMORY ADDRESS F+(h) | FLOOR FL(h) | NUMBER OF ARRIVED PERSONS Mr(h) | NUMBER OF DEPARTED PERSONS Ms(h) | ELEVATOR EVACUATION RATIO $\alpha$(h) | NUMBER OF REMAINDER Mrs(h) |
|---|---|---|---|---|---|
| h:1 | FLOOR 2 F2 | 500 | 200 | 1/30 | 10 |
| | FLOOR 3 F3 | 600 | 300 | 5/30 | 50 |
| | FLOOR 4 F4 | 770 | 380 | 20/30 | 260 |
| | FLOOR 5 F5 | 600 | 300 | 25/30 | 250 |

33g:REMAINDER-NUMBER TABLE

EVACUATION SYSTEM AND METHOD FOR ELEVATOR CONTROL USING NUMBER OF PEOPLE REMAINING

This is a divisional of application Ser. No. 11/688,678 filed Mar. 20, 2007, which is a divisional of application Ser. No. 10/516,541 filed Dec. 2, 2004. The entire disclosures of the prior applications, application Ser. Nos. 11/688,678 and 10/516,541 are hereby incorporated by reference.

TECHNICAL FIELD

The present invention relates to a fire control system for elevators for rescuing people remaining in a building by means of an elevator when a fire occurs in the building.

BACKGROUND ART

A conventional fire control system for elevators for rescuing the people remaining in a building is disclosed in, for example, Japanese non-examined laid-open patent publication No. Hei 5-8954. According to this document, when a fire occurs in a building wherein the service floors are divided into a plurality of zones, the elevator system carries out fire control operation by giving the first priority to the elevator group in service to the zone including the floor on which the fire occurred, and the next priority to the group in service to the zone right above the zone to which the floor where the fire occurred belongs.

Furthermore, in Japanese non-examined laid-open patent publication No. Hei 10-182029, there is disclosed an elevator system wherein the passengers inside the car are evacuated in the event of fire by leading the car to a floor other than the floor on which the fire occurred.

Since the floors of buildings are partitioned into fire-prevention divisions in prescribed floor area units, fire does not spread from one division to another. The elevator hoistway is also a fire-prevention division, and is separated from the floors.

When a fire occurs, on the one hand damage may spread, on the other the damage may not be so serious due to activation of a sprinkler. Furthermore, the number of remainders varies widely according to the type and floor of the building.

As aforementioned, since there is a diversity in fires of buildings, there is the problem that uniform setting of elevator service in case of fire is not suitable to the actual conditions of building fires.

The present invention was devised to solve the above-mentioned problems, and has as its object the rescue of the remainders inside the building by operating the elevator according to the conditions of the building and the fire in case of a fire.

DISCLOSURE OF THE INVENTION

1. In the fire control system for an elevator in the present invention wherein the people remaining in the building are taken to the evacuation floor by rescue operation when a fire detector provided in the building is activated, the estimated time until the fire and smoke reach the elevator hall of each floor is pre-calculated as the evacuation time of the floor; the floor of which the evacuation time is longer than the time required for making a car respond to the rescue call is judged as a rescue floor, and the floor of which the evacuation time is shorter than the time required for making a car respond to the rescue call is judged as a non-rescue floor; and furthermore, the order of rescue among the rescue floors is determined and rescue operation is carried out.

For this reason, it is possible to use elevators as an evacuation means in the event of a fire, as well as being able to rescue the people remaining on the rescue floor avoiding fire and smoke.

Moreover, since rescue operation is carried out with the order of rescue determined, rescue operation suitable for the conditions of the fire becomes possible.

2. Furthermore, in the present invention, rescue operation is carried out on the rescue floors in the increasing order of evacuation time, which is the time within which the fire and smoke reach the elevator hall.

For this reason, it is possible to rescue the remainders giving priority to the floors with higher urgency.

3. Furthermore, in the present invention, rescue operation is carried out on the rescue floor in the decreasing order of the number of remainders.

Accordingly, the number of remainders on each floor becomes almost equal as rescue operation progresses, and it is possible to complete rescue almost simultaneously.

4. Moreover, in the present invention, the number of remainders described in the third paragraph is the number of persons obtained by subtracting the number of persons rescued by the rescue operation from the initial value, where the initial value is the number of persons which is the result from subtracting the estimated number of evacuees using the emergency staircase from the pre-registered enrollment.

For this reason, it is possible to figure out the number of remainders at the time reflecting the result of rescue operation.

5. Furthermore, in the present invention, the number of remainders described in the third paragraph is the number of persons which is the result from subtracting the number of persons who have left each floor using an elevator from the number of persons who have entered each floor using an elevator.

Accordingly, since it is possible to figure out the number of persons remaining on each floor without the pre-registered enrollment, the fire control system for elevators in the present invention may be applied to buildings with many visitors.

6. Moreover, in the present invention, the number of persons remaining is detected by an image photographed by a photographing means provided in the elevator hall of each floor.

For this reason, it is possible to detect the actual number of remainders who are actually to evacuate by means of an elevator.

7. Furthermore, in the present invention, the rescue operation means selects a rescue floor in the order determined by the rescue-operation-order determining means, and the remainders are rescued by activating all cars from the evacuating floor to the selected rescue floor.

Accordingly, since all the cars arrive almost simultaneously at the rescue floor and rescue the remainders, it is possible to prevent panic during evacuation.

8. Moreover, in the present invention, the rescue operation means assigns and simultaneously activates the number of cars that are necessary for carrying the remainders on the rescue floor to the evacuation floor in the order determined by the rescue operation order determining means, and as for the remaining cars, the number of cars necessary for carrying the remainders on the rescue floor to the evacuation floor are sequentially assigned and activated simultaneously from the evacuation floor in accordance with the order.

For this reason, since no redundant cars are assigned to one rescue floor, it is possible to improve carrying capacity and to shorten the time required to complete rescue of the remainders.

9. Furthermore, in the present invention, a hall rescue-operation indicating means for indicating the judgment of the rescue floor judging means is provided in the elevator hall.

Accordingly, the people remaining in the elevator hall may judge with facility whether or not the elevator will respond to a rescue call.

10. Moreover, in the present invention, a car rescue-operation indicating means for indicating rescue operation is provided inside the car.

For this reason, it is possible to notify with facility the passengers inside the car of the occurrence of emergency.

11. Furthermore, according to the present invention, the elevator hall of each floor is provided with at least one fire door, and the elevator hall of a floor which is judged as rescue floor is separated by the fire door.

Accordingly, it is possible to separate the elevator hall from the rooms used by people and to prevent spreading of fire, and also to prevent the remainders from crowding in the elevator hall when the elevators are out of service.

BRIEF DESCRIPTION OF THE DRAWINGS

FIG. 5 is a table representing the contents of an evacuee-number table 33*a* of the fire control system for an elevator in accordance with the first embodiment of the present invention;

FIG. 6 is a diagram for explaining the run curve of the elevator;

FIG. 7 is a table representing the contents of a rescue-response-time table 33*b* of the fire control system for an elevator in accordance with the first embodiment of the present invention;

FIG. 8 is a table representing the contents of an elevator-related fire-detector-activation table 33*c* of the fire control system for an elevator in accordance with the first embodiment of the present invention;

FIG. 9 is a table representing the contents of a room-related fire-detector-activation table 33*d* of the fire control system for an elevator in accordance with the first embodiment of the present invention;

FIG. 10 is a diagram for explaining the rise in temperature in an elevator hall Eh in case of a fire;

FIG. 11 is a table representing the contents of an evacuation-time table 33*e* of the fire control system for an elevator in accordance with the first embodiment of the present invention;

FIG. 12 is a table representing the contents of a rescue-operation-order table 33*f* of the fire control system for an elevator in accordance with the first embodiment of the present invention;

FIG. 13 is a table representing the contents of a remainder-number table 33*g* of the fire control system in accordance with the first embodiment of the present invention;

FIG. 20 is a table representing the contents of a rescue-operation-order table 33*h* of a fire control system for an elevator in accordance with a second embodiment of the present invention;

FIG. 21 is a table representing the contents of a remainder-number table 33*i* of a fire control system for an elevator in accordance with a third embodiment of the present invention;

BEST MODE FOR CARRYING OUT THE INVENTION

Figure 1:
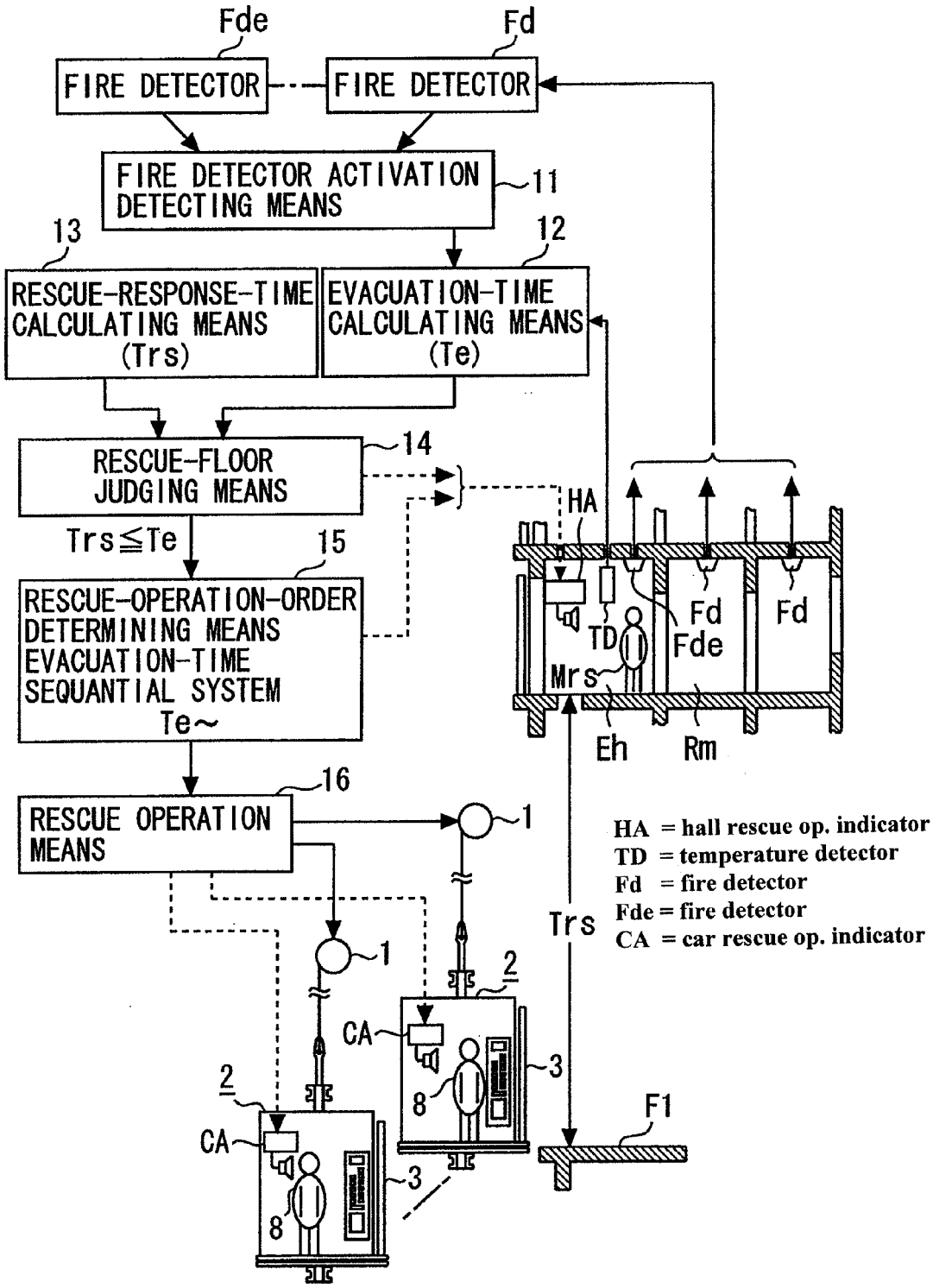
FIG. 1 is a block diagram illustrating the whole structure of a fire control system for an elevator in accordance with a first embodiment of the present invention.

To describe the present invention in more detail, the invention will be described referring to the accompanying drawings. In each of the drawings, the same reference numerals or reference marks are given to the same parts or the corresponding parts, and repeated explanation will be appropriately simplified or omitted.

First Embodiment

FIGS. 1 through 19 show the first embodiment of a fire control system for an elevator in accordance with the present invention.

In the first embodiment, the number of remainders is calculated based on a pre-registered enrollment, and the rescue operation is carried out among the rescue floors in the increasing order of evacuation time.

FIG. 1 is a block diagram illustrating the whole structure of the system; a car 2 is driven to ascend and descend by means of a hoisting machine 1, and the entrance is opened and closed by means of car doors 3. Further, a car rescue-operation indicating means CA for notifying the passengers 8 of the switch to rescue operation due to occurrence of fire is provided.

The evacuation floor F1 of the building is a floor provided with special fire countermeasures. The car 2 travels back and forth between the evacuation floor F1 and the rescue floors in case of a fire to rescue the remainders inside the building. In the rooms Rm, fire detectors Fd are provided. In the elevator hall Eh, a fire detector Fde, a temperature detector TD and a hall rescue-operation indicating means HA are provided. The hall rescue-operation indicating means HA indicates whether or not the floor is judged as a rescue floor and notifies the judgment to any remainders Mrs in the elevator hall Eh.

A fire-detector-activation detecting means 11 generates significant signals when it detects activation of the fire detectors Fd and Fde. An evacuation-time calculating means 12 is activated by the significant signals from the fire-detector-activation detecting means 11, and calculates the time for the current temperature TEp of the elevator hall detected by the temperature detector TD to rise to the limit temperature TEmx, i.e., the evacuation time Te, as shown in FIG. 10. A rescue-response-time calculating means 13 calculates the time required for the car 2 to ascend or descend from the evacuation floor F1 to the rescue floor and opens the doors, i.e., the rescue response time Trs, according to the run curve of the elevator shown in FIG. 6.

A rescue floor-judging means 14 compares the evacuation times Te of each floor calculated by the evacuation-time calculating means 12 with the rescue response times Trs required to reach the floors calculated by the rescue-response-time calculating means 13, and judges a floor as a rescue floor when the evacuation time Te is equal to or more than the rescue response time Trs. A rescue-operation-order determining means 15 determines the order of rescue operation in accordance with the evacuation-time sequential system wherein rescue operation is carried out in the increasing order of evacuation time Te. A rescue operation means 16 carries out rescue operation at the floors judged as rescue floors by the rescue floor-judging means 14 in the order determined by the rescue-operation-order determining means 15.

Figure 2:
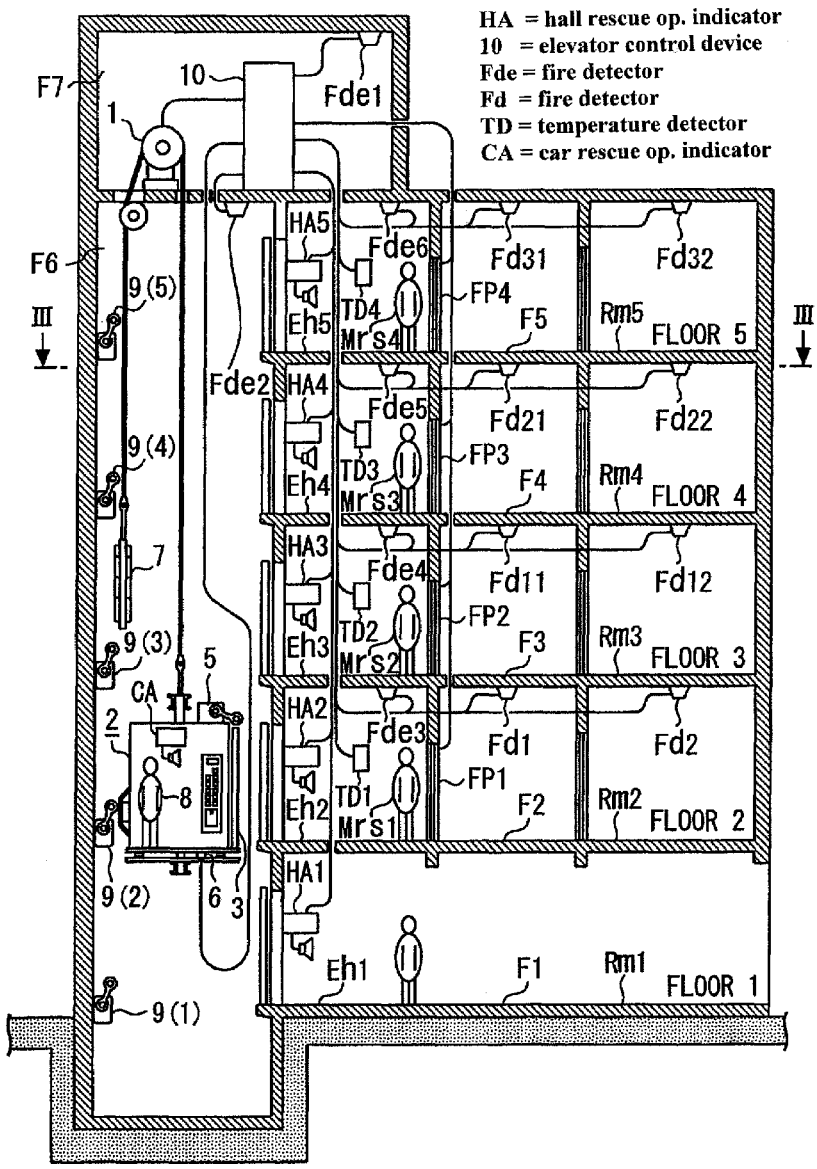
FIG. 2 is a longitudinal sectional view of a building using the fire control system for an elevator in accordance with the first embodiment of the present invention.

FIG. 2 is a longitudinal sectional view of a building using the fire control system for an elevator. Here, the evacuation floor is the ground floor F1, and the building further includes floors F2 through F5 (second to fifth floors).

Here, the parts having the same reference mark as in FIG. 1 except for the final number thereof are the same as the parts in FIG. 1; and the final number means that the part is provided on a different location. For example, HA1 designates a hall rescue-operation indicating means that is provided on the evacuation floor F1, and Fd1 designates a fire detector provided in a room Rm on the second floor F2. In the below-mentioned, the final number will be omitted when referred to generically.

In FIG. 2, the car 2 is housed in a hoistway F6 together with a counterweight 7, and is driven to ascend and descend by a hoisting machine 1 provided in a machineroom F7. Position switches 9(1) to 9(5) are provided on each of the floors F1 to F5, and activate upon arrival of the car 2. These switches will be generically named "position switches 9". The car doors 3 open and close upon arrival of the car 2, and a door switch 5 activates when the car doors 3 close. In each of the elevator halls Eh2 to Eh5 of the second to fifth floors F2 to F5, fire doors FP1 to FP4 are provided, and are shut upon necessity. The equipment is connected to an elevator control device 10 provided in the machineroom F7.

Figure 3:
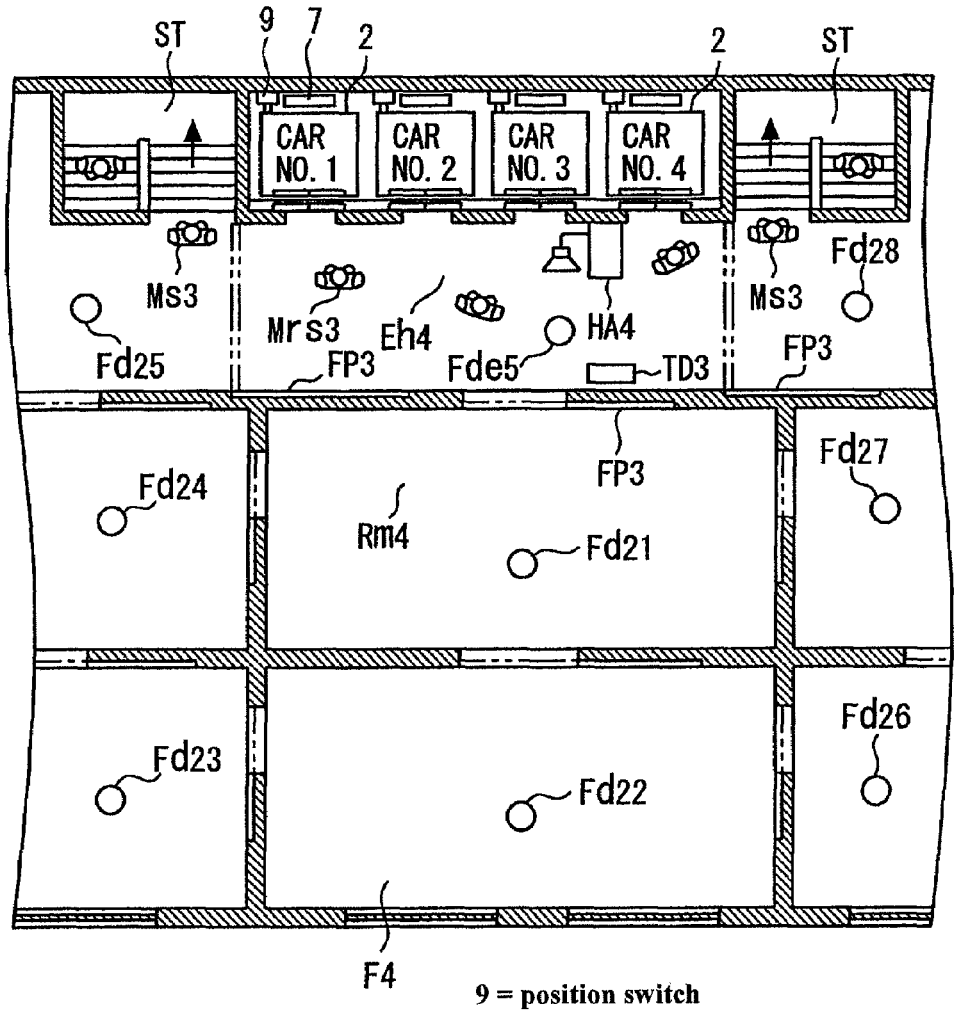
FIG. 3 is a cross sectional view taken along line III-III.

FIG. 3 is a cross sectional view taken along line III-III, and shows a plane of the fourth floor F4.

Similarly, the parts having the same reference mark as in FIG. 1 except for the final number thereof are the same as the parts in FIG. 1; and the final number means that the part is provided on the fourth floor F4.

In FIG. 3, at both sides of the elevator hall Eh4, emergency staircases ST are provided, and emergency-staircase-evacuees Ms3 evacuate thereby.

Figure 4:
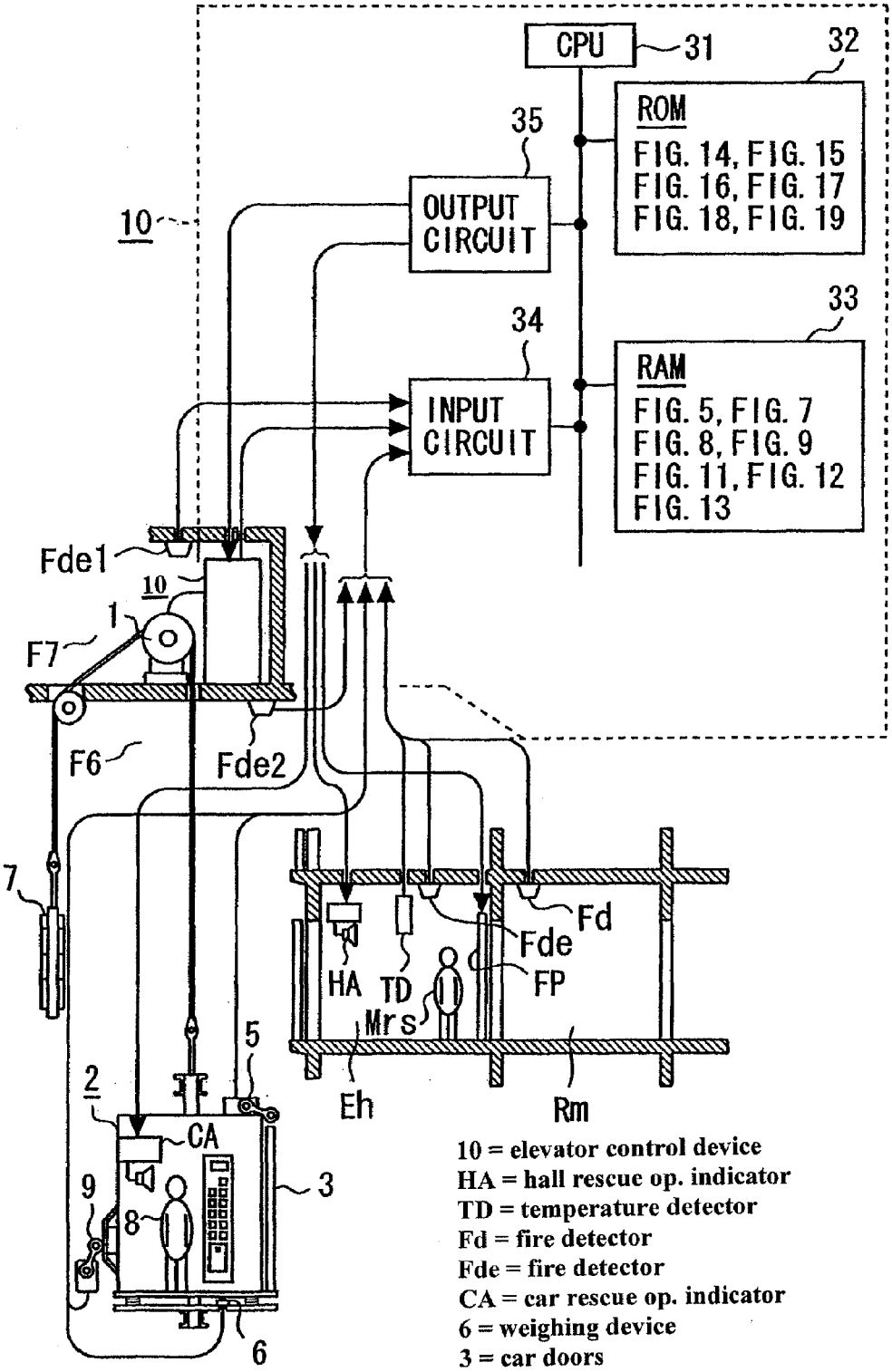
FIG. 4 is a block diagram illustrating an electric circuit of the fire control system for an elevator in accordance with the first embodiment of the present invention.

FIG. 4 is a block diagram illustrating an electric circuit of the fire control system.

An ROM 32 is connected to the bus line of a central processing unit (CPU) 31. In the ROM 32, a program for detecting activation of the fire detectors Fde1, Fde2 and Fde3 to Fde 5 (generically named "Fde" when referred to as elevator-related fire detectors in the following) which are provided in the machineroom F7, the hoistway F6 and the elevator halls Eh; a program for detecting activation of a fire detector Fd provided in a room Rm; a program for calculating the evacuation time Te; a program for determining the order of rescue operation; a program for judging whether or not the floor is a rescue floor; a program for commanding rescue operation; and a program for calculating the number of remainders Mrs; are recorded.

An RAM 33 comprises of a memory in which is recorded: an evacuee-number table 33*a* of the number of evacuees of each floor; a rescue-response-time table 33*b* in which is recorded the times for rescue using the elevator from the evacuation floor F1 to each of the floors; a fire-detector-activation table 33*c* for recording the activation situation of the elevator-related fire detector Fde; a fire-detector-activation table 33*d* for recording the activation situation of the fire detector Fd provided in the room Rm; an evacuation-time table 33*e* in which is recorded the time for the fire to spread to the elevator hall Eh; a rescue-operation order table 33*f* for recording the order of rescue operation in increasing order of evacuation time; a remainder-number table 33*g* for recording the number of remainders awaiting rescue on each floor; and temporary data.

The fire detectors Fde and Fd, a temperature detector TD, a door switch 5, a weighing device 6, and an elevator control device 10 are connected to an input circuit 34. Signals of the position, and start and stop of the car 2 are inputted from the elevator control device 10.

An output circuit 35 is connected to an elevator control device 10, a car rescue-operation indicating means CA, a hall rescue-operation indicating means HA provided on each floor, and a fire door FP, which separates the elevator hall Eh.

The CPU 31, the ROM 32, the RAM 33, the input circuit 34, the output circuit 35 and the elevator operation circuit are placed inside the elevator control device 10. Further, the data to be written in the RAM 33 is written manually as well as by the operation signals from other devices.

FIG. 5 is a table representing the contents of an evacuee-number table 33*a*, and an example based on the building in FIG. 2 is given. The floor FL(j) is a memory address in which the number of the floor is recorded. Similarly, the enrollment Mn(j) is a memory address in which the enrollment pre-registered on the list for each floor is recorded. The number Ms (j) of emergency-staircase-evacuees is a memory address in which is recorded the number of persons on the enrollment on the list for each floor estimated to evacuate using the emergency staircase ST. The number Me(j) of elevator-evacuees is a memory address in which is recorded the number of persons of the enrollment estimated to evacuate using an elevator.

Accordingly, when j is 1, the floor FL(j) becomes FL1, and the second floor F2 is recorded in that address. Similarly, the enrollment of 300 persons of the second floor F2 is recorded on the enrollment Mn1. The number of emergency-staircase-evacuees of the second floor F2 of 290 persons is recorded in the number of emergency-staircase-evacuees Ms1. The number of elevator-evacuees of the second floor F2, i.e., 10 persons, is recorded in the number of elevator-evacuees Me1.

The floor FL(j) is a memory address in which is recorded the number of the floor; however, in the following explanation, this may also refer to the number of the floor recorded in that address. That is, the floor FL1 is the second floor F2, when j equals 1. Similarly, the enrollment Mn(j), the number Ms(j) of emergency-staircase-evacuees, and the number Me(j) of elevator-evacuees may refer to the contents recorded in the respective addresses.

FIG. 6 shows the run curve of the elevator; the rescue response time Trs required for the car 2 to reach a floor for rescue consists of an acceleration time Ta, a time Tm to travel at rated speed, a deceleration time Tr, a time Tdo for the doors to open, a boarding time Tgo for the evacuees to board the car 2 at the rescue floor, and a time Tdc for the doors to close.

The opening and closing time Toc of the doors is fixed. Assuming that the number of persons boarding is equal to the riding capacity of the car 2, the time Tgo for the evacuees to board also becomes fixed. Accordingly, the rescue response time Trs can be calculated if the distance Ds from the evacuation floor F1 is specified.

FIG. 7 shows an actual example representing the contents of a rescue-response-time table 33*b*, and is an example of the rescue response time Trs necessary for an elevator of a rated speed of 90 m per minute and having the carrying capacity of 11 persons to carry out rescue at each of the floors.

Here, in the case where k is 1, the second floor F2 is recorded as the floor FL1, 3 m is recorded as the distance Ds1 from the evacuation floor F1, 1.5 seconds is recorded as the acceleration time Ta, 0.5 seconds as the time Tm1 traveling at the rated speed, 1.5 seconds as the acceleration time, 4 seconds as the opening and closing time Toc of the doors, and 9 seconds as the boarding time Tgo assuming that 11 persons are boarding. Accordingly, the rescue response time Trs totals 19.5 seconds. The same applies to the rest of the floors.

The floor FL1 in the case where k is 1 and the floor FL1 in the case where j is 1 in FIG. 5 indicate different memory addresses. To explain in detail, when k is 1 the (C+1) address is indicated, and when j is 1 the (B+1) address is indicated. Accordingly, the floor FL1 when k is 1 and the floor FL1 when j is 1 are recorded in different addresses, and one address is never repeatedly used. The same applies to the rest of the floors.

FIG. 8 is a table representing the contents of an elevator-related fire-detector-activation table 33*c* in which is recorded the state of activation of the elevator-related fire detectors, and is an example based on the building shown in FIG. 2.

In the case where g is 1, the fire detector Fde1 is recorded in the memory address Fde1, the machineroom F7, which is the floor onto which the fire detector Fde1 is fixed, is recorded in the memory address FL1, and an "OFF" showing the state of activation is recorded in the memory address FNe1. When g is 2, the state of activation of the fire detector Fde2 in the hoistway F6 is recorded. When g is 3 to 6, the states of activation of the fire detectors Fde3 to Fde6 of the elevator halls Eh are recorded. The same applies to the rest of the elevator-related fire detectors.

FIG. 9 is a table representing the contents of a room-related fire-detector activation table 33*d*, and is an example based on the building show in FIG. 2.

In the case where m is 1, the fire detector Fd1 is recorded in the memory address Fd1; the second floor F2 is recorded in the memory address FL1, in which is recorded the floor onto which the fire detector Fd1 is fixed; and an "OFF" is recorded in the memory address FN1 showing the state of activation of the fire detector Fd1.

The same applies to the rest; the fire detector Fd22 recorded in the memory address Fd22 when m is 22 shows by the entry in the memory address FL22 that the fire detector Fd22 is provided on the fourth floor F4, and that the state of activation thereof is recorded as "ON" in the memory address FN22 and that the fire detector Fd22 is activated. The same applies to the case where m is 23, and shows that the fire detector Fd23 is activated.

FIG. 10 is a diagram for explaining the rise in temperature in an elevator hall Eh in accordance with the lapse of time from the occurrence of fire.

That is, the room temperature of the elevator hall Eh is detected by a temperature detector TD. Assuming that the highest room temperature enabling rescue operation is the limit temperature TEmx, the time for the current room temperature TEp to rise to the limit temperature TEmx becomes the evacuation time Te. The evacuation time Te does not always shorten according to the lapse of time. Actually, the sprinkler is activated and fire extinction is carried out, so the current room temperature TEp may become lower. In the case where the current room temperature TEp becomes lower, the evacuation time Te becomes longer. For this reason, the evacuation time Te should be constantly calculated by detecting the room temperature of the elevator hall Eh by the temperature detector TD.

FIG. 11 is a table representing the contents of an evacuation-time table 33*e*, and is an example based on the building shown in FIG. 2.

In the case where i is 1, the second floor F2 is recorded in the memory address FL1; the current room temperature TEp 24° C. read from the temperature detector TD1 is recorded in the memory address TEp1; and the evacuation time Te=90 minutes is recorded in the memory address Te1. The same applies to the rest of the room-related fire detectors.

FIG. 12 is a table representing the contents of a rescue-operation order table 33*f*, and the floors are listed from top to bottom in the increasing order of their evacuation times Te which are recorded in the evacuation-time table 33*e*.

In the case where p is 1, each of the values where i is 4 is recorded. That is, in FIG. 12, the fourth floor F4 is recorded in the memory address FL1, and 10 minutes is recorded in the memory address Te1. The same applies to the rest of the floors.

As aforementioned, the memory address FL1 in the case where p is 1, and the memory address FL1 in the case where i is 1 in FIG. 11 are different memory addresses. To describe in further detail, the memory address FL1 where p is 1 indicates the memory address (U+1), and the memory address FL1 where i is 1 indicates the memory address (A+1). Accordingly, these two memory addresses are different, and are never repeatedly used. The same applies to the memory address Te1.

FIG. 13 is a table representing the contents of a remainder-number table 33*g*, wherein the number of persons obtained by subtracting the number of evacuees rescued during the rescue operation until that time with the number of elevator-evacuees Me recorded in the table 33*a* of the number of evacuees in FIG. 5 as the initial value is calculated for each floor and recorded as the number of remainders Mrs. Accordingly, the number of elevator evacuees the elevator Me and the number of remainders Mrs are identical until rescued during rescue operation.

That is, in the case where h is 1, the second floor F2 is recorded in the memory address FL1 indicating the floor; the number of elevator-using evacuees, i.e., 10 persons, which is transferred from the table 33*a* of the number of evacuees is recorded in the memory address Me1; and the number of remainders, i.e., 10 persons, is recorded in the memory address Mrs1. The same applies to the rest of the floors.

In the case where h is 3, 300 is the number of persons recorded in the memory address Me3, and 260 is the number of persons recorded in the memory address Mrs3. This means that 40 persons are already rescued by means of an elevator.

Next, the motion of the fire control system for an elevator will be explained based on FIG. 14 to FIG. 19. This motion is repeated at a fixed time interval.

Figure 14:
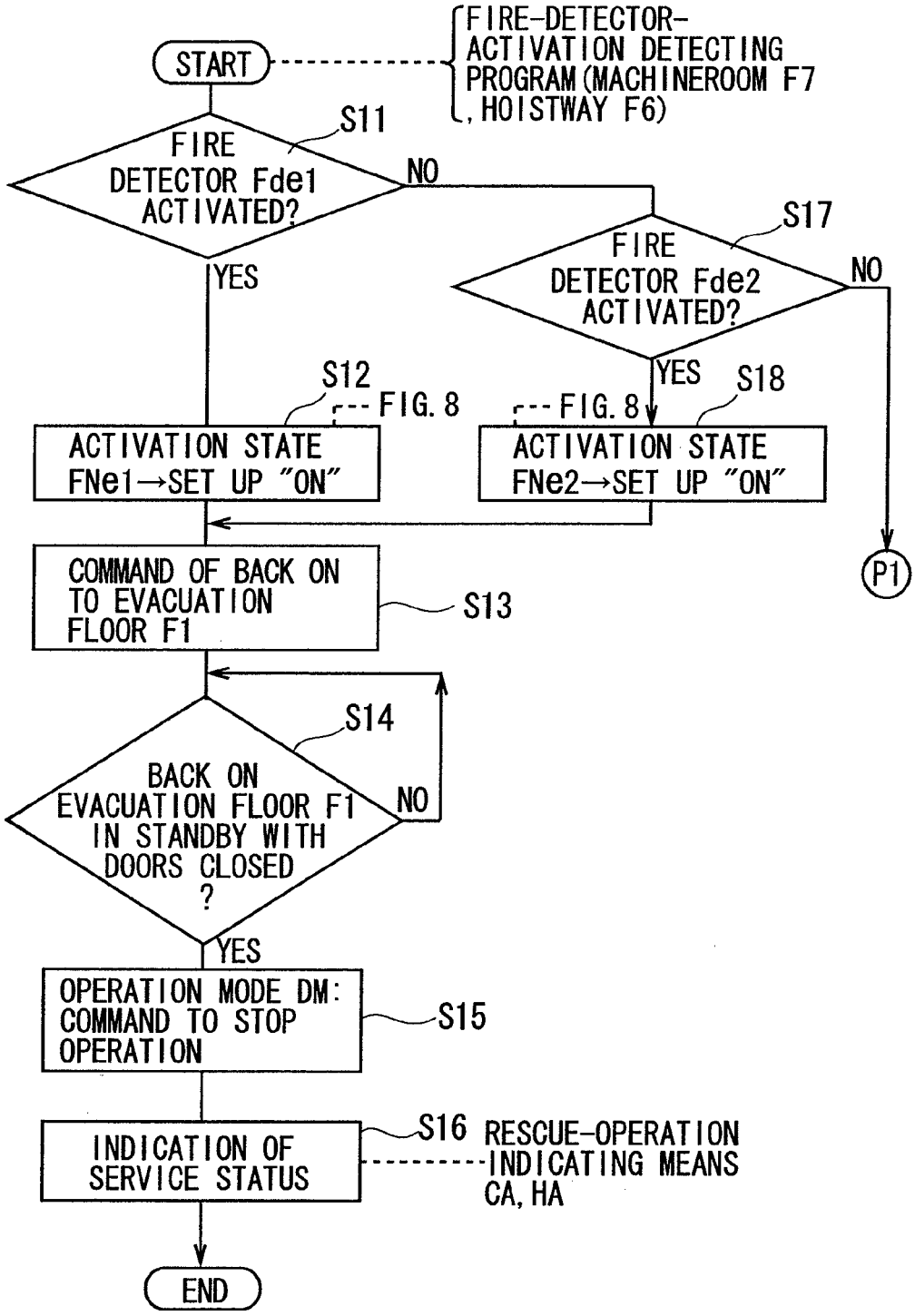
FIG. 14 is a flowchart of a machineroom and hoistway fire-detector-activation detecting program of the fire control system for an elevator in accordance with the first embodiment of the present invention.

FIG. 14 is a program for detecting activation of the fire detectors Fde1 and Fde2 provided in the machineroom F7 and the hoistway F6.

In step S11, a check is made on whether the fire detector Fde1 of the machineroom F7 is activated. If the fire detector Fde1 is activated, the memory address (hereinafter referred to as 'activation state') FNe1 indicating the activation state of the fire detector activation table 33*c* is set to "ON" in step S12. In step S13, a command is given to the elevator control device 10 to return the car 2 to the evacuation floor F1. After the car 2 returns to the evacuation floor F1 and opens its doors and closes them again and becomes in standby in step S14, the operation mode DM is set to out of operation in step S15. In step S16, a notice of "out of service" is indicated by the car rescue-operation indicating means CA and the hall rescue-operation indicating means HA, and the process is completed. Accordingly, in this case, rescue operation is not carried out.

In the case where the fire detector Fde1 of the machineroom F7 is not activated in step S11, the process moves on to step S17, and a check is made on whether or not the fire detector Fde2 of the hoistway F6 is activated. If the fire detector Fde2 is activated, the activation state FNe2 is set to "ON", and the process moves on to step S13 and is followed as mentioned above.

Figure 15:
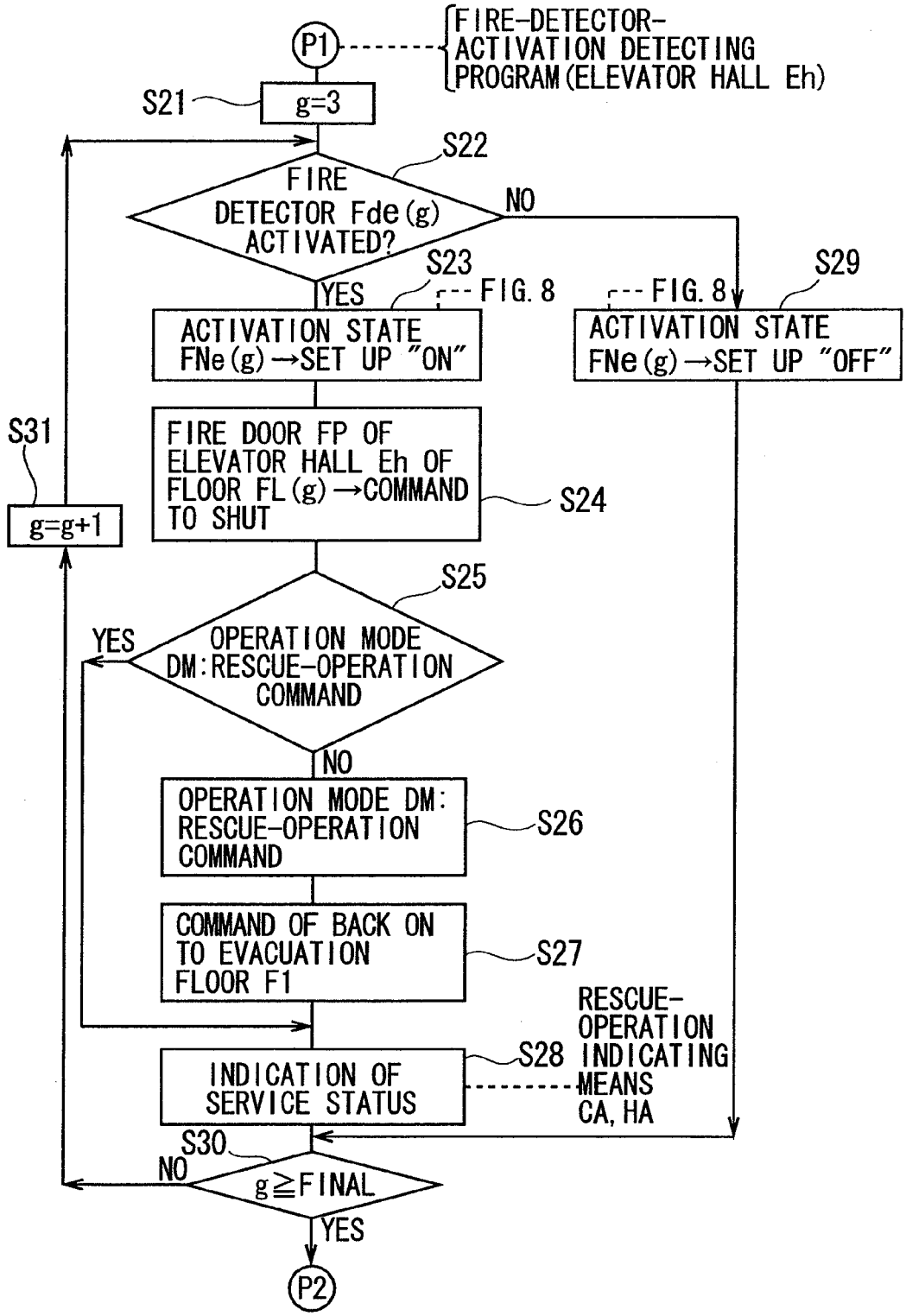
FIG. 15 is a flowchart of an elevator-hall fire-detector-activation detecting program of the fire control system for an elevator in accordance with the first embodiment of the present invention.

In the case where the fire detector Fde2 of the hoistway F6 is not activated in step S17, the process moves on to the process shown in FIG. 15.

FIG. 15 is a program for detecting activation of the fire detectors Fde3 to Fde6 provided in the elevator halls Eh.

In step S21, g is set to 3, and in step S22, activation of the fire detector Fde3 of the second floor F2 is checked. If the fire detector Fde3 is activated, the activation state FNe3 of the fire detector activation table 33*c* is set to "ON" in step S23. In step S24, a command to close is given to the fire doors FP1 of the elevator hall Eh2 of the second floor F2. In the case where the operation mode DM is not yet switched to the rescue operation command in step S25, the operation mode DM is set to the rescue operation command at step S26, and a command is given to the elevator control device 10 at step S27 to return the car 2 to the evacuation floor F1. In step S28, a notice of "in rescue operation" is indicated by the rescue-operation indicating means CA and HA. In the case where the operation mode DM is already switched to the rescue operation command in step S25, the process moves on to step S28 and the aforementioned notice is indicated, and moves further on to step S30.

In the case where the fire detector Fde3 is not activated in step S22, the process moves on to step S29 and the activation state FNe3 of the fire detector activation table 33*c* is set to "OFF", and then moves on to step S30.

Figure 16:
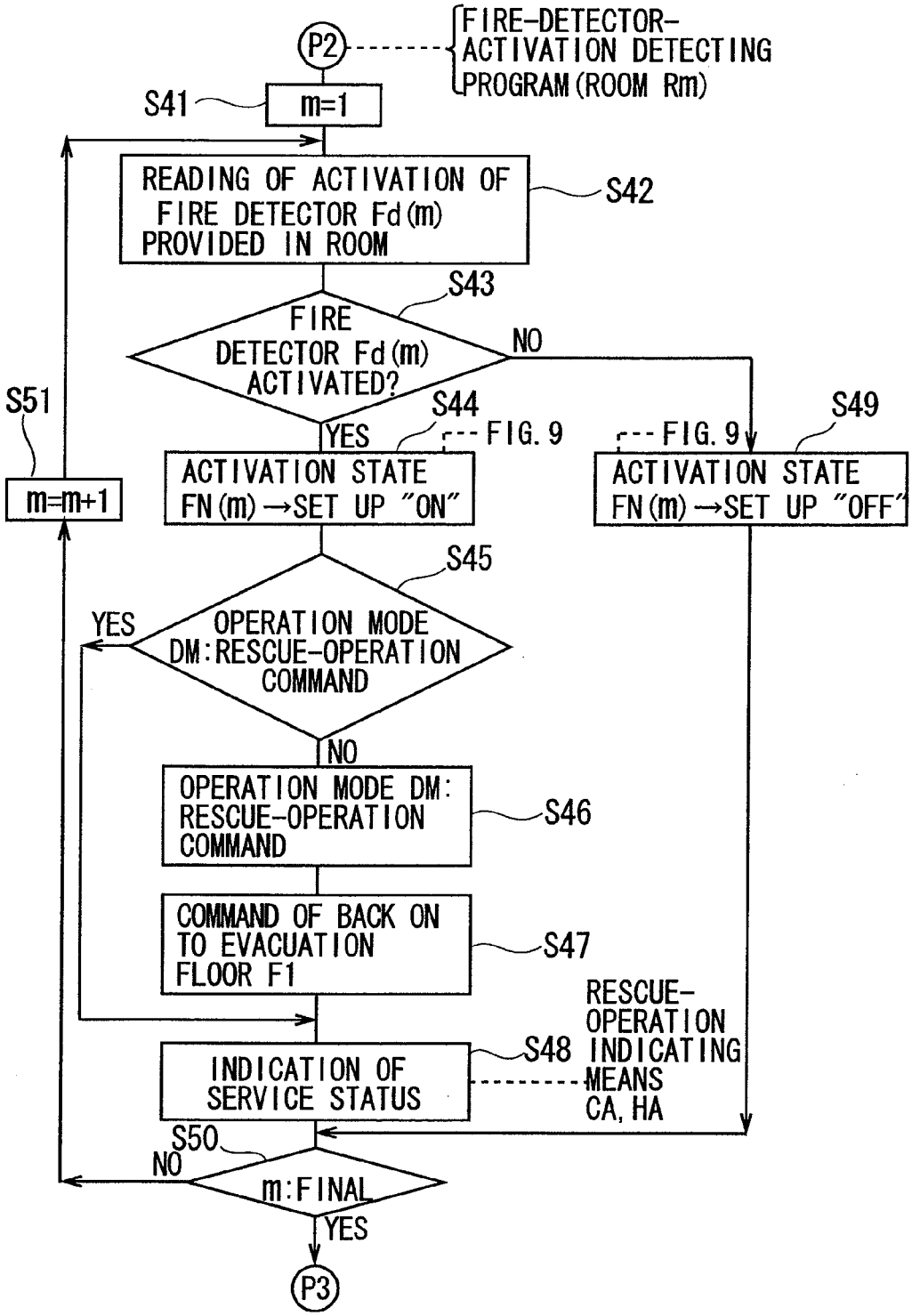
FIG. 16 is a flowchart of a room fire-detector-activation detecting program of the fire control system for an elevator in accordance with the first embodiment of the present invention.

The same process is put in motion via step S30 and step S31 until the process for the final fire detector Fde(g) provided in the elevator hall Eh is completed, and then the process moves on to the process shown in FIG. 16.

FIG. 16 is a program for detecting activation of fire detectors Fd(m) provided in the rooms Rm.

In step S41, m is set to 1. Here, the variable m shows that it is related to the fire detector activation table 33*d* shown in FIG. 9. In step S42 and step S43, a check is made on whether or not the fire detector Fd1 is activated. If the fire detector Fd1 is activated, the activation state FN1 of the fire detector activation table 33*d* is set to "ON" in step S44. In the case where the operation mode DM is not yet switched to the rescue operation command in step S45, the operation mode DM is set to the rescue operation command in step S46, and a command is given to the elevator control device 10 in step S47 to return the car 2 to the evacuation floor F1. In step S48, a notice of "in rescue operation" is indicated by the rescue-operation indicating means CA and HA. In the case where the operation mode DM is already switched to the rescue operation command in step S45, the process moves on to step S48 and the aforementioned notice is indicated, and moves further on to step S50.

In the case where the fire detector Fd1 is not activated in step S43, the process moves on to step S49 and the activation state FN3 of the fire detector activation table 33*d* is set to "OFF", and then moves on to step S50.

Figure 17:
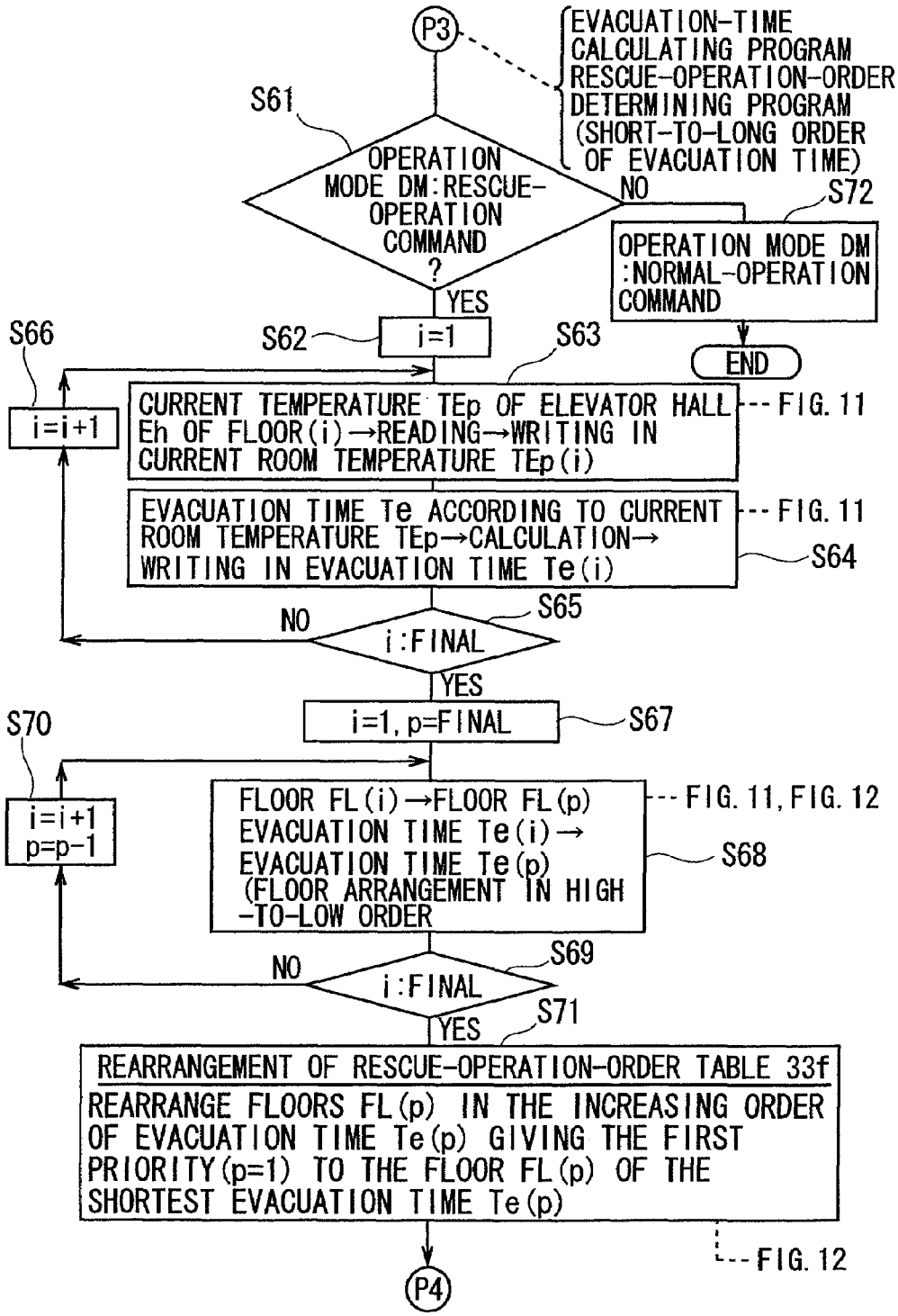
FIG. 17 is a flowchart of an evacuation-time calculating program and a rescue-operation-order determining program of the fire control system for an elevator in accordance with the first embodiment of the present invention.

The same process is put in motion via step S50 and step S51 until the process for the final fire detector Fd(m) provided in the elevator hall Eh is completed, and then the process moves on to the process shown in FIG. 17.

FIG. 17 is a program for determining the order of rescue operation by calculating the evacuation times Te.

In step S61, a check is made on whether or not the operation mode DM is the rescue operation command.

In the case where the operation mode DM is not the rescue operation command, the process moves on to step S72 and the operation mode DM is set to the normal operation command, and the process is completed.

In the case where the operation mode DM is the rescue operation command, i is set to 1 in step S62. Here, since the variable i is related to the evacuation-time table 33*e* shown in FIG. 11, the floor FL1 is the second floor F2. In step S63, the current room temperature TEp of the floor FL1, i.e., the second floor F2, is read from the temperature detector TD1, and is recorded in the current room temperature TEp1 of the evacuation-time table 33*e*. In step S64, the evacuation time Te according to the room temperature TEp is calculated based on FIG. 10, and is recorded in the evacuation time Te1 in the evacuation-time table 33*e*. The same process is repeated via step S65 and step S66 until the process for the last variable i is finished and the evacuation-time table 33*e* is completed; then the process moves on to step S67.

Step S67 to step S71 are steps to determine the order of rescue operation according to the evacuation-time table 33*e*.

During rescue operation, priority is given to high floors. Therefore, in the processes of step S67 to step S70, a rescue-operation order table 33*f* is made up by changing the arrangement of the floors to the high-to-low order from the evacuation-time table 33*e* in which the floors are arranged in the low-to-high order. Furthermore, in step S71, the floor FL(p) of which the evacuation time Te(p) is the shortest in the rescue-operation order table 33*f* is recorded in the earliest memory address, i.e., the memory address where p is 1. After the rescue-operation table 33*f* is completed by rearranging the floors in the increasing order of evacuation time Te(p), the process moves on to the process shown in FIG. 18. Here, since the rearrangement process in step S71 is already mentioned, detailed explanation will be omitted.

Figure 18:
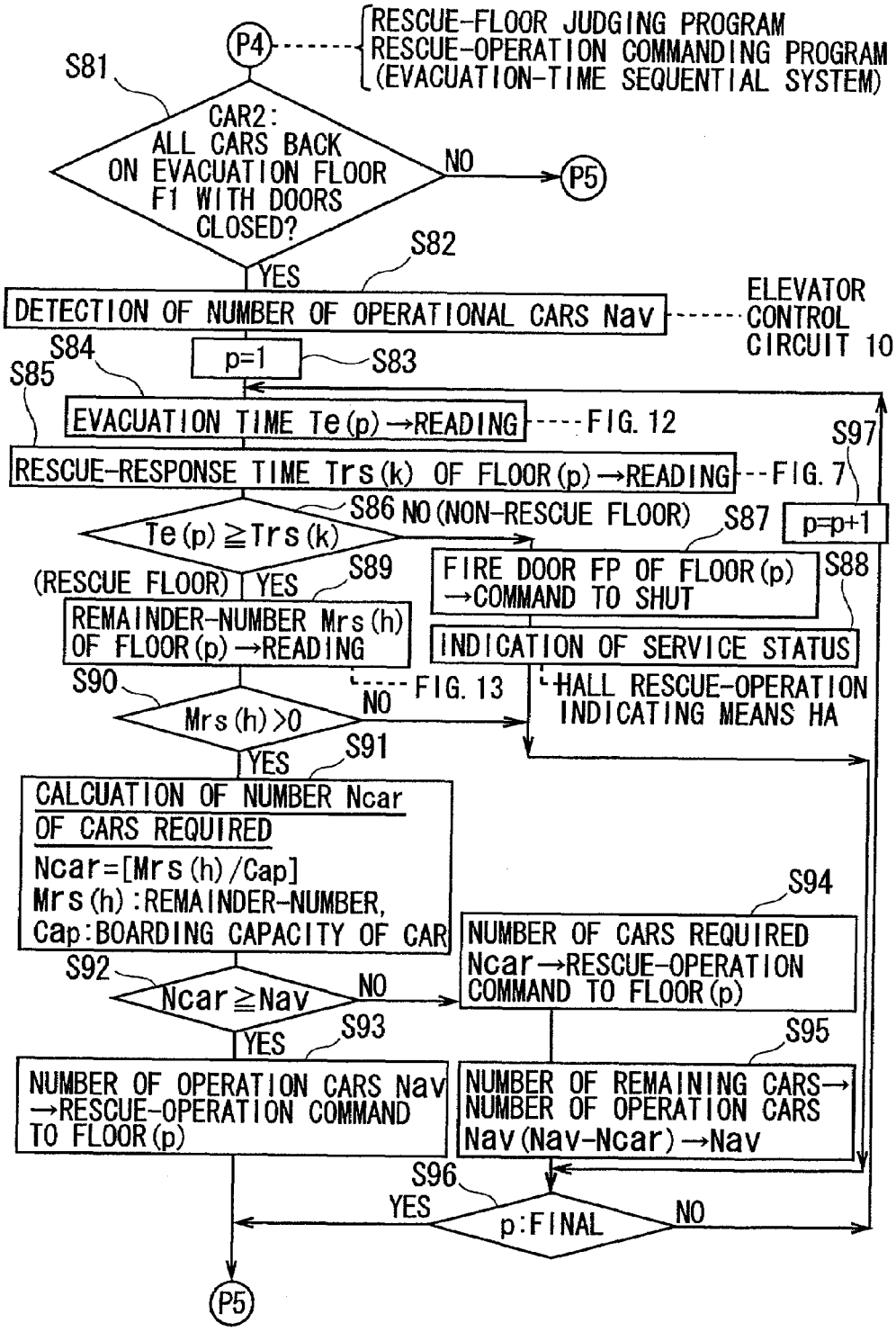
FIG. 18 is a flowchart of a rescue floor judging program and a rescue-operation commanding program of the fire control system for an elevator in accordance with the first embodiment of the present invention.

FIG. 18 is a program for judging rescue floor and for commanding rescue operation in the determined order.

In step S81, a check is made on whether all the cars 2 are back on the evacuation floor F1 and are in standby with doors closed. In the case where the cars 2 are not in standby with doors closed, the process moves on to the process shown in FIG. 19. In the case where the cars 2 are in standby with doors closed, in step S82, the number of cars that are ready for rescue operation is detected by the elevator control device 10 and written in the number Nav of cars. In step S83, the variable p is set to 1. In step S84, the evacuation time Te1, i.e. 10 minutes, is read from the rescue-operation table 33*f*. In step S85, the rescue-response time Trs(k) for the floor FL1 is read out. That is, since the variable p is related to the rescue-operation order table 33*f* shown in FIG. 12, the floor FL1 becomes the fourth floor F4. Accordingly, the rescue-response time Trs(k) becomes 29.5 seconds, which is the rescue-response time Trs(4) for the fourth floor F4 in FIG. 7. In step S86, the evacuation time Te1, i.e., 10 minutes, and the rescue-response time Trs(4), i.e., 29.5 seconds, are compared. Since the evacuation time Te1, i.e., 10 minutes, is longer, the process moves on to step S89, and the number Mrs(h) of remainders is read out. Since the floor FL1 is the fourth floor F4 also here, in FIG. 13, the number Mrs4 of remainders becomes 260. Accordingly, the process moves from step S90 to step S91, and the number Ncar of cars required for rescuing the remainders Mrs4 of 260 persons is calculated. That is, $$\text{number } Ncar \text{ of cars required} = \frac{(\text{number } Mrs4 \text{ of remainders} = 260)}{(\text{capacity Cap of car} = 11)} = 23.6 \text{ cars,}$$

where the capacity Cap of the car 2 is 11. Raising the number to the nearest whole number makes 24 cars. Since the number Ncar of cars required is not less than the number Nav of all the operational cars, i.e., four, the process moves on to step S93 where a rescue-operation command to move to the floor FL1=the fourth floor F4 is given to all the operational cars 2, and then moves on to the program of FIG. 19. The elevator operation circuit drives the cars 2 to the fourth floor F4 according to the above-described rescue-operation command.

In the case where the number Mrs(h) of remainders has decreased and not all of the operational cars Nav are required in step S92, the process moves on to step S94, and a command is given to forward the number of required cars Ncar to the floor FL(p). In step S95, the number of remaining cars (Nav−Ncar) is newly set as the number Nav of operational cars. In step S96, in the case where rescue operation has been carried out on the final floor FL(p), the process moves on to the program shown in FIG. 19. In the case where rescue operation has not been carried out on the final floor FL(p), the process moves on to step S84 via step S97, and the evacuation time Te(p) for the next floor FL(p) is read out. The above-mentioned processes are repeated.

In the case where the current room temperature TEp rises and the evacuation time Te(p) decreases and becomes less than the rescue-response time Trs(k) in step S86, the process moves on to step S87, and a command to shut the fire door(s) FP of that floor FL(p) is given. In step S88, an indication "not available for evacuation" is given by the hall rescue-operation indicating means HA, and the process moves on to step S96. In the case where rescue operation is carried out for the final floor FL(p), the process moves on to the program shown in FIG. 19.

Figure 19:
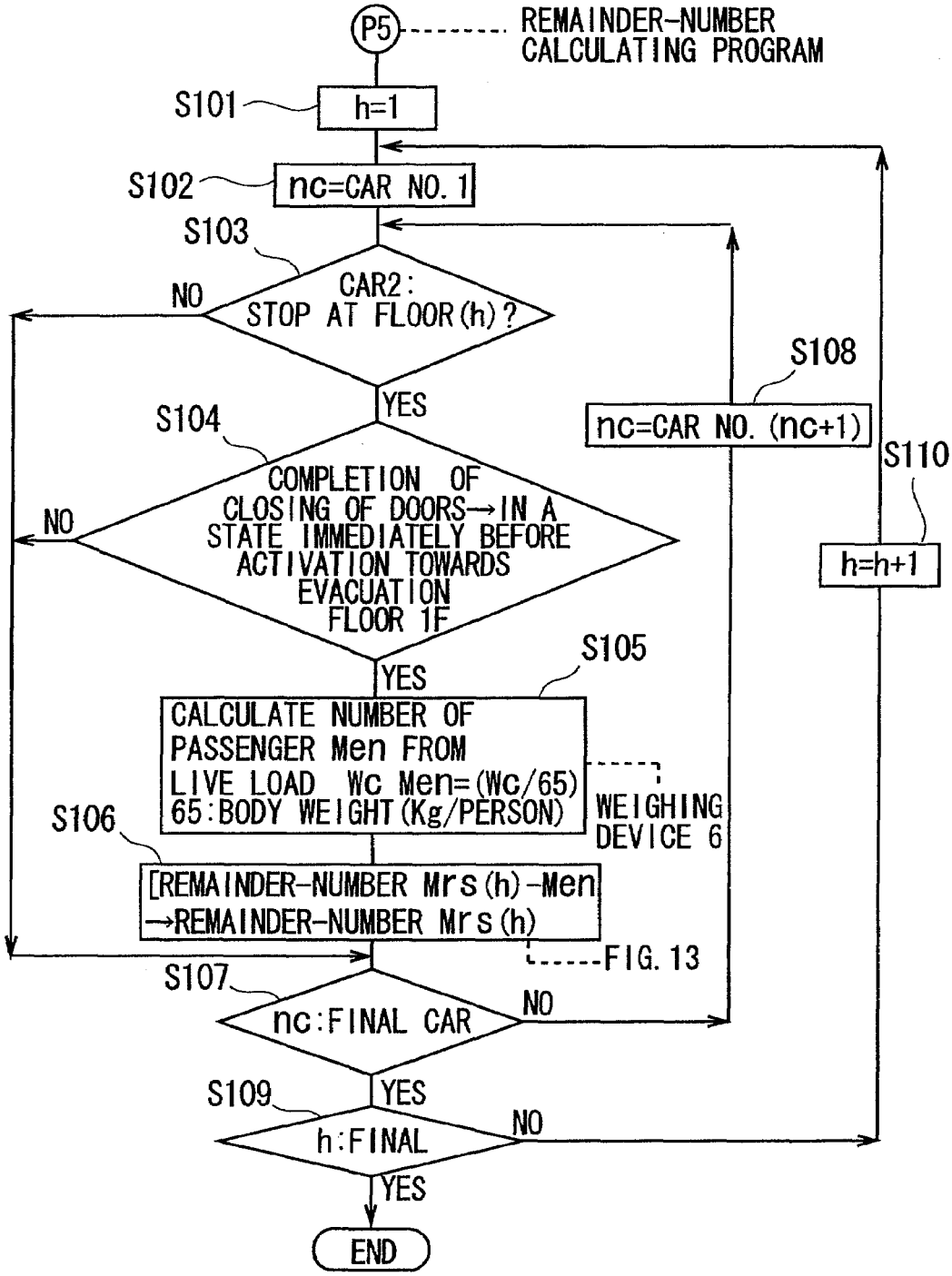
FIG. 19 is a flowchart of a remainder-number calculating program of the fire control system for an elevator in accordance with the first embodiment of the present invention.

FIG. 19 is a program for calculating the number of remainders of each of the floors. Since the number of remainders changes due to rescue operation, the number is amended in accordance with the change.

In step S101, the variable h is set to 1. In step S102, the variable nc indicating the car number of the car 2 is set to 1. In step S103, a check is made on whether or not car No. 1 is stopped at the floor FL(h), i.e., floor FL1. Since the variable h is related to the remainder-number table 33*g* shown in FIG. 13, the floor FL1 becomes the second floor F2.

Step S103 and step S104 are processes for detecting the timing for weighing the live load Wc of the car 2 by means of a weighing device 6. That is, in step S103 a check is made on whether or not the car 2 is stopped at the second floor F2, and in step S104 a check is made on whether or not the car 2 is in a state immediately before closing of the doors 3 and before activation towards the evacuation floor F1. In the case where the two above-mentioned conditions are not satisfied, the process moves on to step S107. In the case where both of the two above-mentioned conditions are satisfied, the output from the weighing device 6 is read out and the live load Wc is calculated in step S105. The number Men of passengers is calculated by dividing the live load Wc by the weight per person, i.e., 65 kilograms. In step S106, the formula

[number Mrs1 of remainders−number Men of passengers]

is calculated, and the result thereof is written as a new number Mrs1 of remainders. By this writing, the number Mrs1 of remainders is amended. In step S107 and step S108, the same processes are carried out for the next car. After the processes for the final car are completed, the same processes are carried out in step S109 and S110 where h is 2, i.e., for the floor FL2, which is the third floor F3. The process is completed when the processes for the final floor is completed in step S109.

The processes of one cycle of the rescue operation are completed as mentioned above. After a predetermined interval of time, the process is restarted beginning from step S11 of FIG. 14 to carry out rescue operation according to the changes in the conditions of the fire.

According to the above-described first embodiment, the evacuation time Te, which is the time for the smoke and fire to reach the elevator hall, of each of the floors is calculated, a floor of which the evacuation time Te is longer than the time Trs for making a car 2 to respond to a rescue call newly from the evacuation floor F1 is judged as a rescue floor, and a floor of which the evacuation time Te is shorter than the time for making a car respond to a rescue call is judged as a non-rescue floor, and the remainders on the rescue floor are rescued. Thus, it is possible to carry out rescue operation before the fire reaches the elevator.

Furthermore, since rescue operation is carried out on the rescue floor in the increasing order of evacuation time Te, it is possible to rescue the remainders starting with the floor of the highest urgency, and to realize rescue operation suitable for the conditions of the fire.

Moreover, the elevator-evacuees Me is the number of persons obtained by subtracting the number of emergency-staircase-evacuees from the number of persons pre-registered on the enrollment of each floor, and the number Mrs of remainders is obtained by subtracting the number of persons rescued by means of an elevator at that point of time from the above-mentioned evacuees Me. Thus, as for office buildings with few visitors, it is possible to figure out the accurate number Mrs of remainders, and to realize efficient rescue operation, since the car 2 will not be in service to the floors with no remainders Mrs.

Furthermore, since all the cars 2 are activated from the evacuation floor F1 to the selected rescue floor simultaneously so as to arrive almost at the same time, it is possible to prevent panic during evacuation.

Moreover, since the number of cars 2 required to transport the remainders Mrs on the rescue floor is assigned and simultaneously activated from the evacuation floor F1, and the number of cars 2 are required to transport the remainders on the rescue floors of the following priorities are sequentially assigned from the remaining cars 2, no redundant cars 2 are assigned to one rescue floor. Thus, it is possible to improve transportation efficiency during rescue operation, and to rescue the remainders in a short time.

Furthermore, because a hall rescue-operation indicating means HA is provided in the elevator hall to indicate the rescue-operation situation, it is possible for the remainders Mrs in the elevator hall Eh to easily judge whether or not the elevator will respond to a rescue call.

Moreover, since a car rescue-operation indicating means CA is provided also inside the car 2, it is possible to notify the passengers 8 inside the car 2 of the occurrence of emergency.

Also, the elevator hall Eh of each floor is provided with a fire door(s) FP, and the elevator hall Eh of floors which are judged as a non-rescue floor is separated by the fire door FP. Thus, it is possible to separate the elevator hall Eh from the rooms Rm used by people and to prevent spreading of fire, and also to prevent the remainders Mrs from crowding in the elevator hall Eh.

In the above-described first embodiment, an example where the building is a five-story building is given, however, the building to which the system is applied is not limited to a five-story building. The system may be applied by generating tables corresponding to each of the data tables 33*a* to 33*g* to suit the building. This fact is easily known by analogy from the above-mentioned.

Second Embodiment

FIG. 20 shows the second embodiment of the present invention. In the second embodiment, rescue operation is carried out starting with the rescue floor with the largest number of remainders.

That is, FIG. 20 shows a rescue-operation-order table 33*h* with the number of remainders listed in decreasing order, and is a table wherein the numbers of the remainders Mrs of each floor shown in the remainder-number table 33*g* of FIG. 13 are arranged in decreasing order. The arrangement is based on the processes according to step S67 to step S71 in FIG. 17, and can be easily known by analogy. Thus, detailed explanation will be omitted.

According to the above-mentioned second embodiment, the number of remainders Mrs becomes almost equal among the rescue floors as the rescue operation progresses, and rescue can be completed almost at the same time.

Third Embodiment

Figure 22:
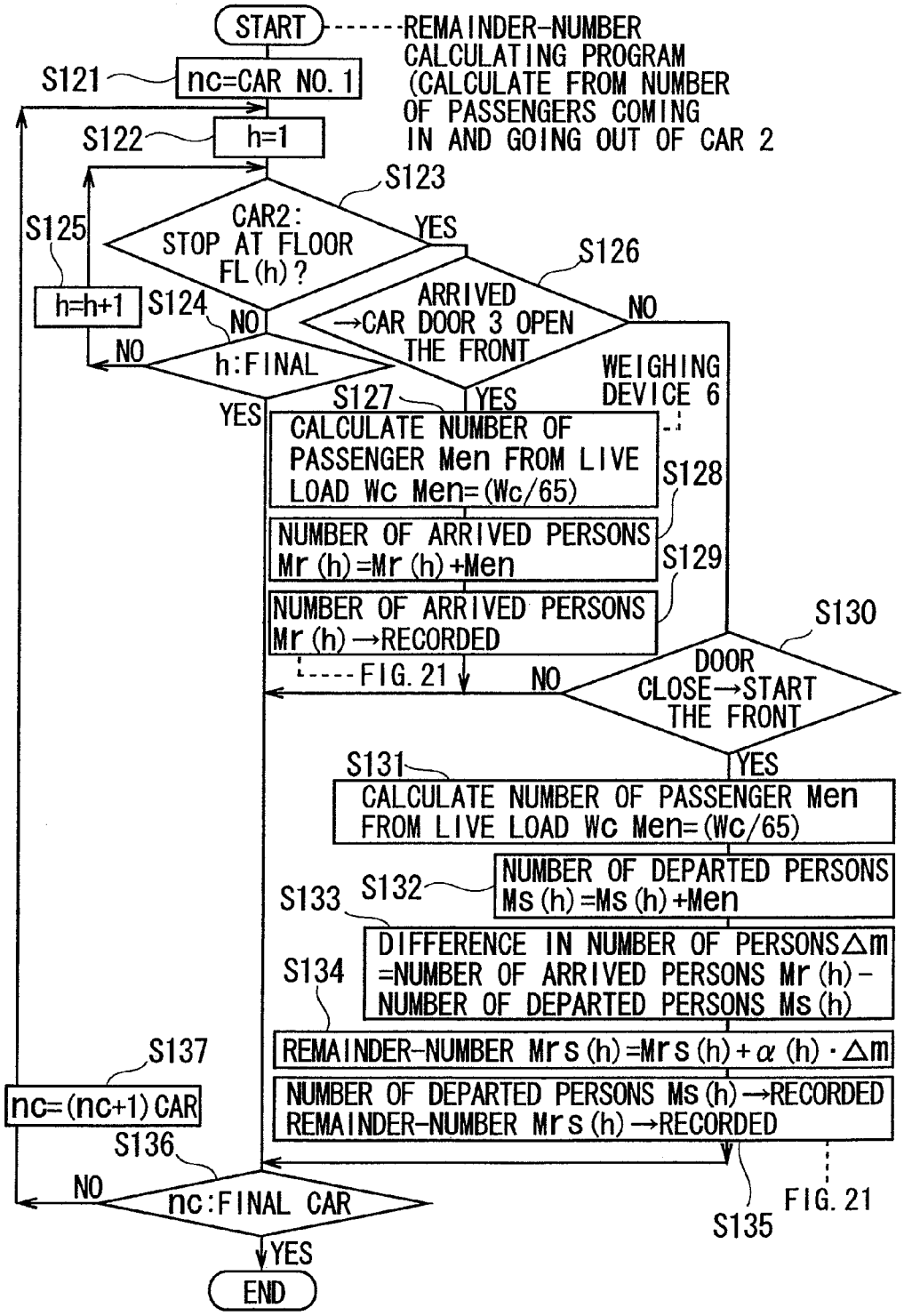
FIG. 22 is a flowchart of a remainder-number calculating program of a fire control system for an elevator in accordance with the third embodiment of the present invention.

FIG. 21 and FIG. 22 show the third embodiment of the present invention. In the third embodiment, the number of remainders is counted by subtracting the number of persons who have left the floor using an elevator from the number of persons who have entered the floor using an elevator. Instead of the remainder-number table 33*g* of FIG. 13 and the remainder-calculating program of FIG. 19 in the first embodiment, the remainder-number table 33*i* of FIG. 21 and the remainder-calculating program of FIG. 22 are used for carrying out rescue operation.

FIG. 21 shows the contents of the remainder-number table 33*i*. The name of each floor is recorded in the floor FL(h), the number of persons who entered each floor FL(h) from a car 2 is recorded in the number Mr(h) of arrived persons, and the number of persons who entered a car 2 from each floor FL(h) is recorded in the number Ms(h) of departed persons. The ratio of persons who are potential of evacuating using an elevator on each floor is recorded in the elevator-evacuation ratio $\alpha(h)$. In the remainder number Mrs(h), the results obtained by calculating the following formula is recorded:

$$\{Mr(h)-Ms(h)\}\times\alpha(h).$$

FIG. 22 is a program for calculating the number of remainders of each floor, and is a program that develops the remainder-number table 33*i*.

In step S121, the variable nc which indicates the car number of the car 2 is set to 1. In step s123, a check is made on whether or not the car 2 No. 1 is stopped at the floor FL(h), i.e., the floor FL1. Since the variable h is related to the remainder-number table 33*i* shown in FIG. 21, the floor FL1 becomes the second floor F2. If car 2 No. 1 is not stopped at the floor FL1, a check is made in step S123, step S124 and step S125 on whether or not car No. 1 is stopped at each of the other floors FL(h). If car 2 No. 1 is not stopped at any of the floors FL(h), the same check is made for the car of the next car number in the increasing order of car number in step S136 and step S137.

Step S123 to step S129 are processes for calculating the number Mr(h) of arrived persons Mr(h). In step S123, if car 2 No. 1 is stopped at the floor FL1, i.e., the second floor F2, the process moves on to step S126, and a check is made whether or not the car 2 is immediately before opening of the car doors 3 after arrival. That is, step S126 is a process for detecting the timing for weighing the live load Wc of the car 2 by means of a weighing device 6. If the car 2 is immediately before opening doors, the process moves on to step S127, and the live load Wc is calculated by reading the output from the weighing device 6. The number Men of passengers is calculated by dividing the live load Wc by the weight per passenger 8, i.e., 65 kilograms. In step S128, the aforementioned number Men of passengers is added to the number Mr1 of arrived persons at that point of time. In step S129, the obtained value is recorded as the new number Mr1 of arrived persons. The same processes are carried out for the rest of the floors FL(h).

Step S130 to step S135 are processes for calculating the number Ms(h) of departed persons. In step S123, a check is made on whether or not car 2 No. 1 is stopped at the floor FL1, i.e., the second floor F2, and in step S130, a check is made on whether or not the car 2 is immediately before activation with the car doors 3 closed. That is, the step S130 is a process for detecting the timing for weighing the live load Wc of the car 2 by means of a weighing device 6. If the car 2 is immediately before activation, the process moves on to step S131, and the live load Wc is calculated by reading the output from the weighing device 6. The number Men of passengers is calculated by dividing the live load Wc by the weight per passenger 8, i.e., 65 kilograms. In step S132, the aforementioned number Men of passengers is added to the number Ms1 of departed persons up to that point of time, and a new number Ms1 of departed persons is obtained. In step S133, the number Ms1 of departed persons is subtracted from the number Mr1 of arrived persons who have arrived at the floor FL1, i.e., the second floor F2, until then, and the difference $\Delta m$ (=Mr1−Ms1) is obtained. In step S134, the value obtained by multiplying the difference $\Delta m$ by the elevator-evacuation ratio $\alpha 1$, i.e., 1/30 of the floor FL1, i.e., the second floor F2 is added to the number Mrs1 of remainders until that time, and a new number Mrs1 of remainders is obtained. In step S135, the amended new number Ms1 of departed persons and new number Mrs1 of remainders are recorded in the remainder-number table 33*i*.

The number Mrs(h) of remainders of the other floors FL(h) is calculated by calculating the number Mr(h) of arrived persons and the number Ms(h) of departed persons in the timings of step S126 and step S130.

As in the first and second embodiments, rescue operation can also be realized according to the remainder-number table 33*i* created as aforementioned.

According to the above-mentioned third embodiment, since the number Mrs(h) of remainders is calculated based on the number of persons who used the elevator, it is possible to figure out the number Mrs(h) of remainders on each floor without using an enrollment, and it is useful for buildings with many visitors.

Fourth Embodiment

Figure 23:
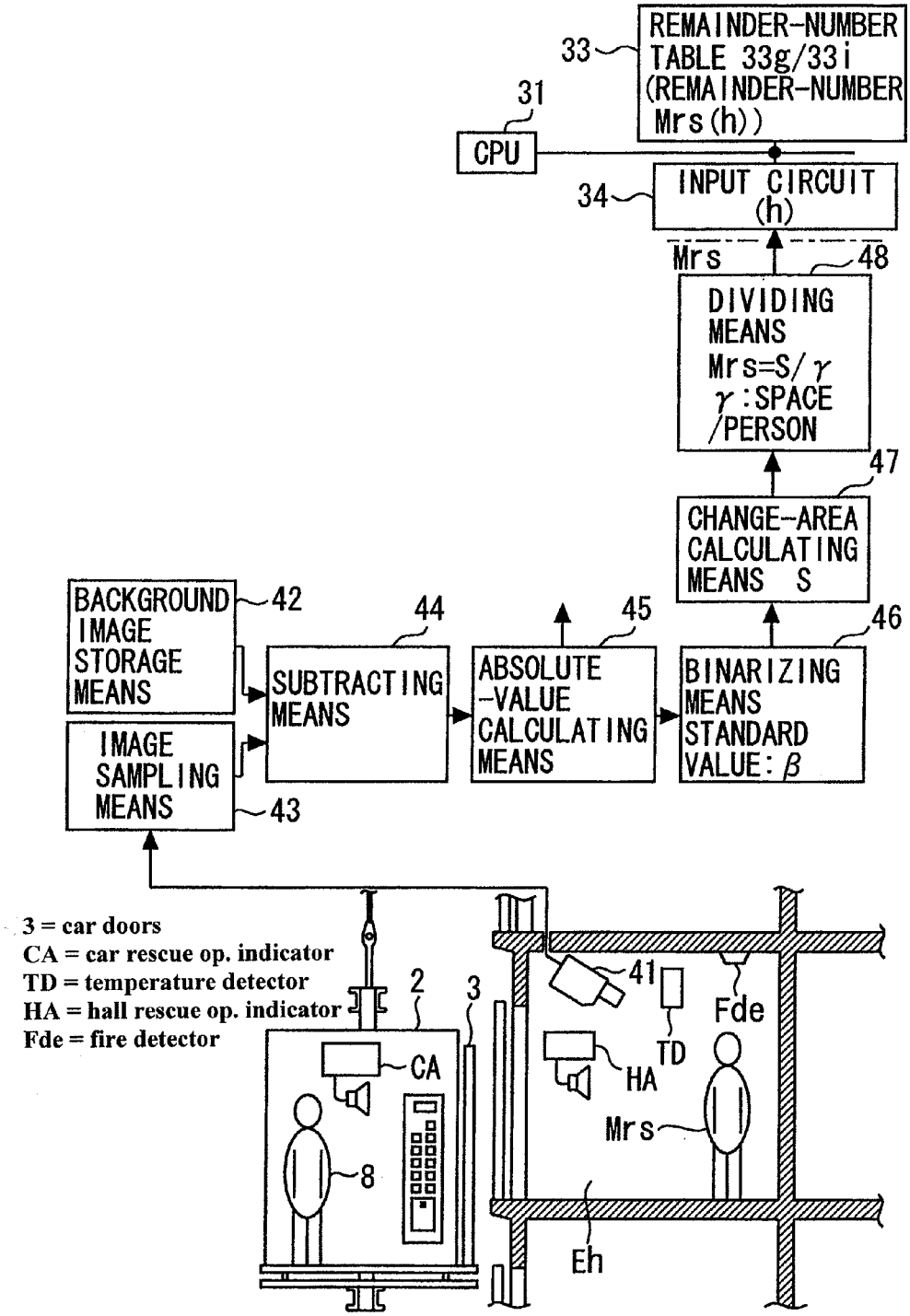
FIG. 23 is a block diagram representing a remainder-number calculating means of a fire control system for an elevator in accordance with a fourth embodiment of the present invention.

FIG. 23 shows the fourth embodiment of the present invention. In the fourth embodiment, the number of remainders is detected from images photographed by a photographing means provided in the elevator hall of each floor.

FIG. 23 is a block diagram showing the structure of the remainder-calculating means. In the drawing, the same reference numbers or reference marks as in FIG. 4 refer to the same parts.

The elevator hall Eh is photographed by a television camera 41, which is a photographing means; the elevator hall Eh when empty is photographed in advance, and the image is stored by a background image storage means 42. An image sampling means 43 imports images from the television camera 41 at a constant frequency. A subtracting means 44 outputs a difference image between the background image of the background image storage means 42 and the image of the image sampling means 43. The difference image is converted to an absolute value image by an absolute-value calculating means 45. The pixels of the absolute value image are compared with a predetermined standard value β by a binarizing means 46; when the value is not larger than the standard value β, the pixel value is 'zero', i.e., 'no change', and when the pixel value is larger than the standard value β, the pixel value is 'one', i.e., 'changed'. The change area S is calculated by a change-area calculating means 47 by counting the pixels of pixel value one. The number Mrs of remainders is obtained by a dividing means 48 by dividing the change area S by the space γ per person in the image of the remainders in the elevator hall Eh. The number Mrs of remainders is calculated for each floor, and is recorded in the number Mrs(h) of remainders in the remainder-number table 33*g* or 33*i* of the RAM 33 via an input circuit 34.

According to the above-described fourth embodiment, because the number of remainders is detected from images photographed by a photographing means provided in the elevator hall of each floor, it is possible to accurately detect the number of remainders to evacuate using an elevator, and to realize rescue operation by means of an elevator suitable for the conditions of the fire.

INDUSTRIAL APPLICABILITY

As aforementioned, the fire control operation system for an elevator in accordance with the present invention can be widely utilized as an evacuation means during fire in buildings provided with (an) elevators.

The invention claimed is:

1. An elevator system comprising:

an evacuation elevator control portion for devising an evacuation plan for a building making use of an elevator based on a disaster information in an event of a disaster, and generating a command to perform evacuation operation, based on the evacuation plan; and an elevator operation control portion for operating an elevator according to the command;

wherein the evacuation elevator control portion determines a number of people remaining inside the building and transmits information on the number of people remaining to an outside.

2. An elevator control method for evacuating people remaining inside a building by using an elevator in an event of a disaster, comprising:

devising an evacuation plan making use of the elevator based on disaster information; and operating the elevator according to the evacuation plan; and determining a number of people remaining inside the building and transmitting information on the number of people remaining to an outside.

* * * * *